US006568311B2

(12) United States Patent
Widemann

(10) Patent No.: US 6,568,311 B2
(45) Date of Patent: May 27, 2003

(54) HYDRAULIC MOTOR WITH SHIFT TRANSMISSION

(75) Inventor: Axel Widemann, Neumunster (DE)

(73) Assignee: Sauer-Danfoss, Inc., Ames, IA (US)

( * ) Notice: Subject to any disclaimer, the term of this patent is extended or adjusted under 35 U.S.C. 154(b) by 11 days.

(21) Appl. No.: 09/908,033

(22) Filed: Jul. 18, 2001

(65) Prior Publication Data

US 2002/0062732 A1 May 30, 2002

(30) Foreign Application Priority Data

Aug. 3, 2000 (DE) ..... 100 37 927

(51) Int. Cl.[7] ..... F01B 1/00; F01B 3/00
(52) U.S. Cl. ..... 91/484; 417/269
(58) Field of Search ..... 91/484, 57, 499, 91/486; 417/269, 222.1; 475/24; 60/487, 222.1; 92/57

(56) References Cited

U.S. PATENT DOCUMENTS 3,698,286 A * 10/1972 Ellis et al. ..... 91/486
3,783,744 A * 1/1974 Benkovic ..... 92/57
3,996,841 A * 12/1976 Gostomski ..... 91/499
4,615,257 A * 10/1986 Valentin ..... 91/499
4,771,676 A * 9/1988 Matsumoto et al. ..... 91/57
4,997,412 A * 3/1991 Reed ..... 475/24
5,073,091 A * 12/1991 Burges et al. ..... 60/222.1
5,251,537 A * 10/1993 Hoshino et al. ..... 91/506
5,295,796 A * 3/1994 Goto et al. ..... 417/222.1
6,099,262 A * 8/2000 Iino et al. ..... 417/269
6,178,746 B1 * 1/2001 Thoma et al. ..... 60/487
6,406,271 B1 * 6/2002 Valentin ..... 417/269

* cited by examiner

*Primary Examiner*—Teresa Walberg
*Assistant Examiner*—Leonid M Fastovsky

(57) ABSTRACT

A hydraulic motor (1), has an output shaft (3), a block cylinder (6), and high-pressure pistons (7) guided therein, and a block cylinder spring (9) and a valve plate (5). The block cylinder (6) exerts a contact-pressure force on the valve plate (5) by way of the charging pressure of the hydraulic oil in the block cylinder (6) and of the spring force of the block-cylinder spring (9). The contact-pressure force is counter-acted, when the hydraulic motor (1) is at a standstill, by a hydraulic pressure field which is built up on a surface (13) between the block cylinder (6) and the valve plate (5) via a valve device (12).

6 Claims, 1 Drawing Sheet

HYDRAULIC MOTOR WITH SHIFT TRANSMISSION

FIELD OF INVENTION

The present invention relates to a hydraulic motor for driving a shift transmission.

BACKGROUND OF THE INVENTION

Together with a pump, usually a variable displacement pump, a typical hydraulic motor forms a so-called hydrostatic drive. The variable displacement pump and the hydraulic motor are connected to one another via corresponding lines and thus form a hydraulic force transmission system. This principle is based on the fact that the hydraulic motor receives the oil-volume stream produced by the variable displacement pump and converts it into a corresponding rotary movement. The oil discharged by the hydraulic motor is then guided back to the variable displacement pump at a lower pressure level. The variable displacement pump is usually equipped with a servo-adjustment means, with the result that the delivery quantity of the oil-volume stream can be adjusted in a stepless manner.

The conventional hydraulic motor can be used for driving a transmission which may be configured such that it can be shifted in one or more stages. The rotational speed of the hydraulic motor is usually reduced by the transmission.

Where a shift transmission is used, it is imperative that the hydraulic motor can be rotated to a slight extent as easily as possible during the shifting operation. It is then possible, within the shift transmission, for the forces acting on the tooth flanks and the shift forks during the shifting operation to be kept to a relatively low level, which, in addition to facilitating the shifting operation, minimizes the wear on the transmission. In particular, for driving a shift transmission, the latter can merely be shifted when the hydraulic motor is at a standstill, i.e., in a neutral position of the variable displacement pump. It is therefore desirable to overcome considerable friction torque within the hydraulic motor.

This friction torque is formed between a valve plate and a block cylinder of the hydraulic motor, which butt mechanically against one another when at a standstill. In this case, on the one hand, the charging pressure is acting on the surface between high-pressure piston and block-cylinder nodule. On the other hand, the spring force of a block-cylinder spring, which is arranged in the interior of the block cylinder, between the latter and the output shaft, cause the block cylinder to exert a contact-pressure force on the valve plate. Together with the material-induced friction of the abutment surface, this contact-pressure force forms a corresponding frictional force.

In order for it then to be possible to rotate the hydraulic motor for shifting purposes when at a standstill, it is imperative to overcome this frictional force. The torque which has to be initiated is generally referred to as a breakaway torque when at a standstill. Of course, a high breakaway torque for shifting a shift transmission proves to be extremely disadvantageous.

It is therefore a principal object of the present invention to keep the motor breakaway torque for shifting a shift transmission as low as possible, with the result that a small rotary movement is sufficient for the necessary shifting operation.

These and other objects will be apparent to those skilled in the art.

SUMMARY OF THE INVENTION

The device according to the invention within the hydraulic motor allows a considerable reduction in the contact-pressure force between the block cylinder and the valve plate of the hydraulic motor, with the result that, in this context, it is also the case that the friction torque between these components which has to be overcome is considerably reduced.

When the hydraulic motor is at a standstill, a hydraulic oil is introduced into the interior of the block cylinder via an additional valve device. In one embodiment of the invention, the hydraulic oil fed for this purpose is removed from the already present charging circuit of the hydraulic oil system of the hydraulic motor and the volume stream thereof is appropriately controlled via the valve device.

In this way, a hydraulic pressure field is built up in a defined surface between the block cylinder and the valve plate, this hydraulic pressure field counteracting the above-mentioned contact-pressure force. The pressure thus building up in the interior of the block cylinder is capable of raising the block cylinder counter to the force of the central blockcylinder spring, on the one hand, and counter to the force of the charging pressure on the other hand, with the result that the mechanical connection between the valve plate and the block cylinder is eliminated. Thus, the breakaway torque of the intermediate hydraulic-oil layer produced in this way is considerably lower than in the case of direct mechanical support of the block cylinder on the valve plate.

In a preferred embodiment of the invention, the surface which is to be subjected to the action of the hydraulic pressure field is defined in that it is sunken in that end side of the block cylinder which is directed toward the valve plate, an intermediate gap being formed in the process. It is possible for a relatively large oil volume to be fed into this intermediate gap and thus for a considerably larger hydraulic pressure field, which can counteract the contact-pressure force, to be built up.

When the hydraulic motor is at a standstill, the supply of the hydraulic oil is maintained via a valve device. Following the shifting operation, the valve device opens again, with the result that the pressure field is dissipated and the hydraulic oil fed is discharged in a pressureless manner via the valve control means.

In a further configuration of the invention, the valve device is activated electronically by a pressure sensor which is arranged in the region of the output shaft. If the shaft is not rotating, for the purpose of shifting the transmission, the sensor transmits a corresponding shifting signal to the valve device. The invention makes it possible to reduce to a considerable extent the frictional force and/or the friction torque for the breakaway of the motor shaft, this reduction being approximately by a factor of five in comparison with actuation in the case of a hydraulic pressure field not being present. A non-synchronized transmission can thus be shifted without difficulty, as a result of which it is also possible to reduce to a considerable extent the mechanical outlay and the signs of wear, which are associated directly therewith, in the shift transmission.

DESCRIPTION OF THE EMBODIMENT OF THE INVENTION

Figure 1:
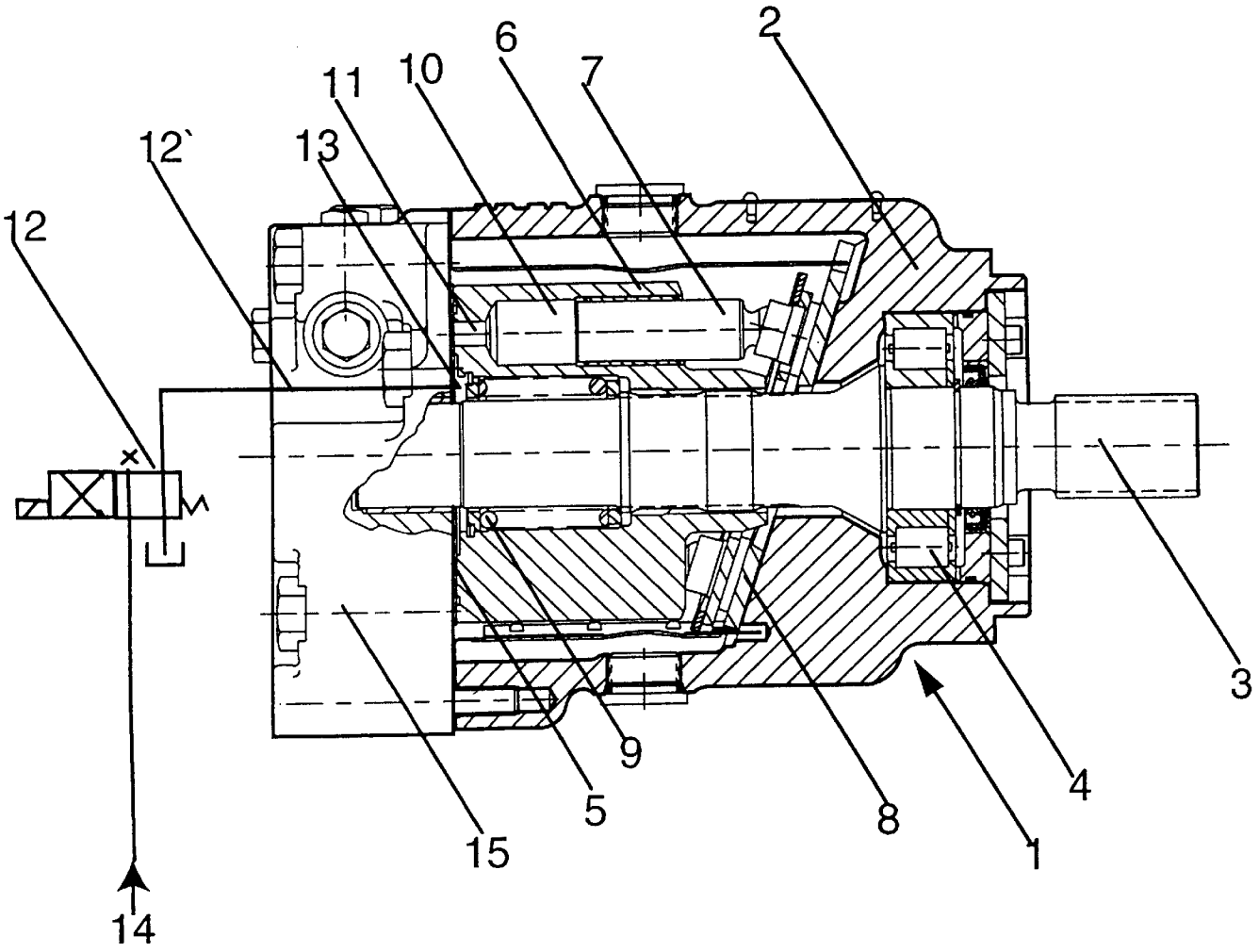
FIG. 1 is a longitudinal sectional view through the device of this invention.

FIG. 1 shows a schematic cross-sectional view of the hydraulic motor at a standstill.

A hydraulic motor 1 has a housing 2 in which an output shaft 3 is mounted in a rotatable manner via a corresponding bearing 4.

Opposite the output side of the hydraulic motor 1, the latter has an end housing 15. For the inflow and outflow of the hydraulic oil necessary for driving purposes, flushing-pressure-limiting and shuttle valves are usually integrated in the end housing 15. A block cylinder 6 is arranged such that it encloses the output shaft 3. A plurality of high-pressure pistons 7 are mounted displaceably in the block cylinder 6. At their opposite ends, the high-pressure pistons 7 are mounted on a swash plate 8 of the hydraulic motor 1. The functioning principle of a hydraulic motor 1 constructed in this way is known to a sufficient extent and will not be discussed in any more detail here.

A block-cylinder spring 9 is arranged in the interior of the block cylinder 6, between the block cylinder 6 and the output shaft 3.

The block-cylinder spring 9 exerts a force in the direction of the valve plate 5. Furthermore, a further contact-pressure force is produced by the charging pressure in the cavity 10, guiding the high-pressure pistons 7 of the block cylinder 6. This is established by the difference in pressure between the displacement surface of the high-pressure pistons 7 and the block cylinder nodule 11.

When the hydraulic motor 1 is at a standstill, and the output shaft 3 is not rotating, the two forces together produce a contact pressure which forces the block cylinder 6 against the valve plate 5, with the result that the corresponding end surfaces of these motor components come to rest one against the other with the formation of an increased friction torque.

The hydraulic oil is introduced into the interior of the block cylinder 6 via a valve device 12 and a corresponding feed line 12' through the end housing 15, with the result that a hydraulic pressure field can build up on a defined surface 13, which results in the block cylinder 6 being forced away from the valve plate 5. The hydraulic oil for the hydraulic pressure field is removed from the charging circuit 14 of the hydraulic motor 1 by the valve device 12.

As can be seen in FIG. 1, the surface 13 is sunken in the end side of the block cylinder 6, with the result that a greater amount of space, and thus a greater application of force, can be made available to the hydraulic pressure field.

It is therefore seen that this invention will at least achieve its stated objectives.

What is claimed is:

1. A hydraulic motor for driving a non-synchronized transmission, comprising, a block cylinder (6) which encloses an output shaft (3) and in which high-pressure pistons (7) are guided; a block-cylinder spring (9) which is arranged between the block cylinder (6) and the output shaft (3); and a valve plate (5) which is located opposite the block cylinder (6); the block cylinder (6) exerting a contact pressure on the valve plate (5) on account of the charging pressure of the hydraulic oil in the block cylinder (6) and of the spring force of the block-cylinder spring (9), wherein, when the hydraulic motor (1) is at a standstill, a hydraulic pressure field oriented counter to the contact-pressure force is built up on a surface (13) between the block cylinder (6) and the valve plate (5) via a valve device (12).

2. The hydraulic motor of claim 1, wherein the surface (13) which is subjected to the action of the hydraulic pressure field is sunken in the end side of the block cylinder (6).

3. The hydraulic motor of claim 1, wherein, hydraulic oil can be removed from the charging circuit (14) of the hydraulic motor (1) to build up the hydraulic pressure field.

4. The hydraulic motor of claim 2, wherein, hydraulic oil can be removed from the charging circuit (14) of the hydraulic motor (1) to build up the hydraulic pressure field.

5. The hydraulic motor of claim 3, wherein the valve device (12) can be activated by a rotational-speed sensor such that, with a rotational speed=0, hydraulicoil is delivered from the charging circuit to the surface (13).

6. The hydraulic motor of claim 4, wherein the valve device (12) can be activated by a rotational-speed sensor such that, with a rotational speed=0, hydraulicoil is delivered from the charging circuit to the surface (13).

* * * * *